United States Patent [19]

Lathers

[11] Patent Number: 4,945,853

[45] Date of Patent: Aug. 7, 1990

[54] RECREATIONAL BOAT SWIVEL SEAT

[75] Inventor: Michael W. Lathers, Metamora, Mich.

[73] Assignee: Outboard Marine Corporation, Waukegan, Ill.

[21] Appl. No.: 216,817

[22] Filed: Jul. 8, 1988

[51] Int. Cl.[5] ..... B63B 17/00

[52] U.S. Cl. ..... 114/363; 297/349

[58] Field of Search ..... 114/363; 297/349, 1, 297/232, 233, 240, 311, 340, 344, 353

[56] References Cited

U.S. PATENT DOCUMENTS

| | | | |
|---|---|---|---|
| D. 151,270 | 10/1948 | Kaufman | D15/11 |
| D. 211,460 | 6/1968 | Zufferey | D15/1 |
| D. 240,481 | 7/1976 | Fister | D6/1 |
| D. 262,421 | 12/1981 | Aronowitz et al. | D6/67 |
| 1,634,922 | 7/1927 | Stubblebine et al. . | |
| 1,766,079 | 6/1930 | Knight et al. . | |
| 1,803,063 | 4/1931 | Hultgren . | |
| 1,876,247 | 9/1932 | Knight . | |
| 3,278,229 | 10/1966 | Bates | 297/349 |
| 3,428,976 | 2/1969 | Robinson | 114/363 |
| 3,486,790 | 12/1969 | Barecki et al. | 297/349 |
| 3,593,954 | 7/1971 | Ritchie et al. | 248/425 |
| 4,098,485 | 7/1978 | Mizelle | 248/425 |
| 4,226,398 | 10/1980 | Freber | 248/415 |
| 4,366,981 | 1/1983 | Ziegler et al. | 297/328 |
| 4,518,139 | 5/1985 | Barfell | 297/349 |
| 4,655,632 | 4/1987 | Smith | 297/349 |

FOREIGN PATENT DOCUMENTS

| | | |
|---|---|---|
| 1247401 | 10/1960 | France . |
| 8441 | 4/1908 | United Kingdom . |

*Primary Examiner*—Sherman D. Basinger
*Assistant Examiner*—Stephen P. Avila
*Attorney, Agent, or Firm*—Michael, Best & Friedrich

[57] ABSTRACT

A marine vehicle comprising a deck, and an L-shaped seat including a seat back member, the seat back member including a first portion, and a second portion generally perpendicular to the first portion, the seat being mounted on the deck for pivotal movement about a generally vertical axis and between a first position wherein the first portion faces fore and a second position wherein the second portion faces aft.

21 Claims, 2 Drawing Sheets

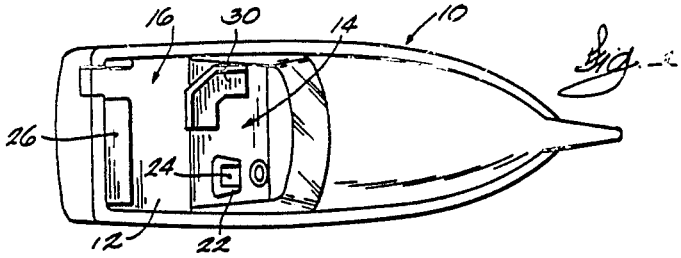
Fig. 1
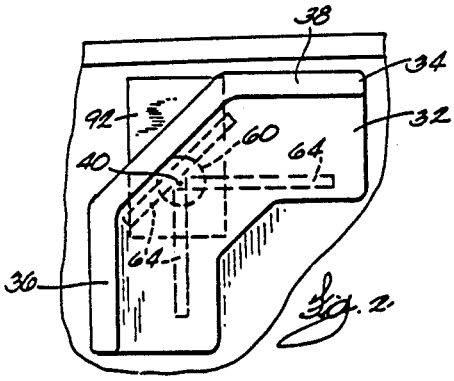
Fig. 2
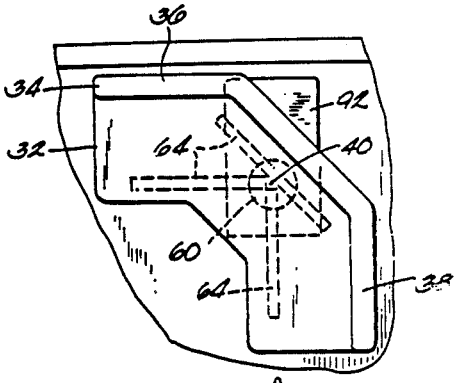
Fig. 3
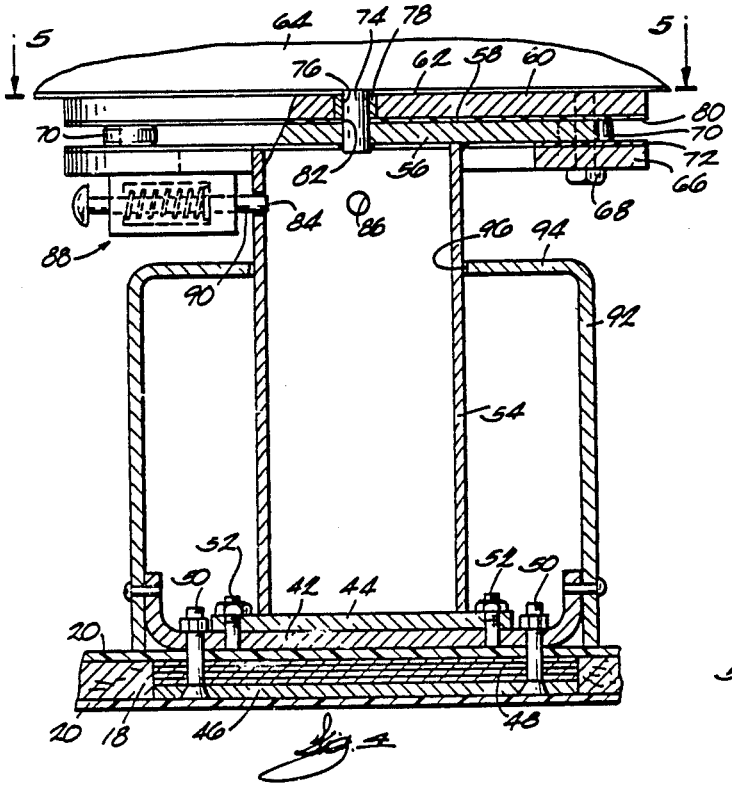
Fig. 4
Fig. 6
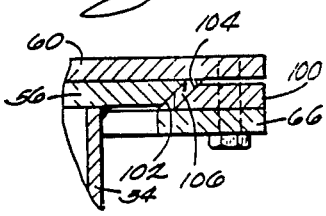

RECREATIONAL BOAT SWIVEL SEAT

BACKGROUND OF THE INVENTION

The invention relates to recreational boats, and, more particularly, to seats for such boats.

It is known to provide a recreational boat with a seat that pivots about a generally vertical axis. It is also known to provide other types of recreational vehicles with similar seats.

SUMMARY OF THE INVENTION

The invention provides a marine vehicle comprising a deck, an L-shaped seat including a seat back member, the seat back member including a first portion, and a second portion generally perpendicular to the first portion, and means mounting the seat on said deck for pivotal movement about a generally vertical axis and between a first position wherein the first portion faces fore and a second position wherein the second portion faces aft.

The invention also provides a marine vehicle comprising a deck, a seat, and means mounting the seat on the deck for pivotal movement about a generally vertical axis, the mounting means including a first generally horizontal plate supported by the deck and having an upper surface, and a second generally horizontal plate supported by the upper surface of the first plate and having an upper surface supporting the L-shaped seat.

A principal feature of the invention is the provision of an L-shaped seat including a seat back member having a first portion, and a second portion generally perpendicular to the first portion, and means mounting the seat for pivotal movement about a generally vertical axis and between a first position wherein the first portion faces fore and a second position wherein the second portion faces aft. The seat faces forwardly for use as a front passenger seat and faces rearwardly for entertaining in the aft seating area.

Another principal feature of the invention is the provision of mounting means including a first generally horizontal plate having an upper surface, and a second generally horizontal plate supported by the upper surface of the first plate and having an upper surface supporting the seat.

Other features and advantages of the invention will become apparent to those skilled in the art upon review of the following detailed description, claims and drawings.

DESCRIPTION OF THE DRAWINGS

FIG. 1 is a plan view of a recreational boat embodying the invention and including an L-shaped seat, a driver's seat, and an aft seat.

FIG. 2 is an enlarged, partial plan view showing the L-shaped seat in its forwardly facing position.

FIG. 3 is a view similar to FIG. 2 and showing the L-shaped seat in its rearwardly facing position.

FIG. 4 is a side elevational view, partially in section along line 4—4 in FIG. 5, of the means for mounting the L shaped seat.

FIG. 6 is a partial view similar to FIG. 4 and illustrating an alternative embodiment of the invention.

Figure 5:
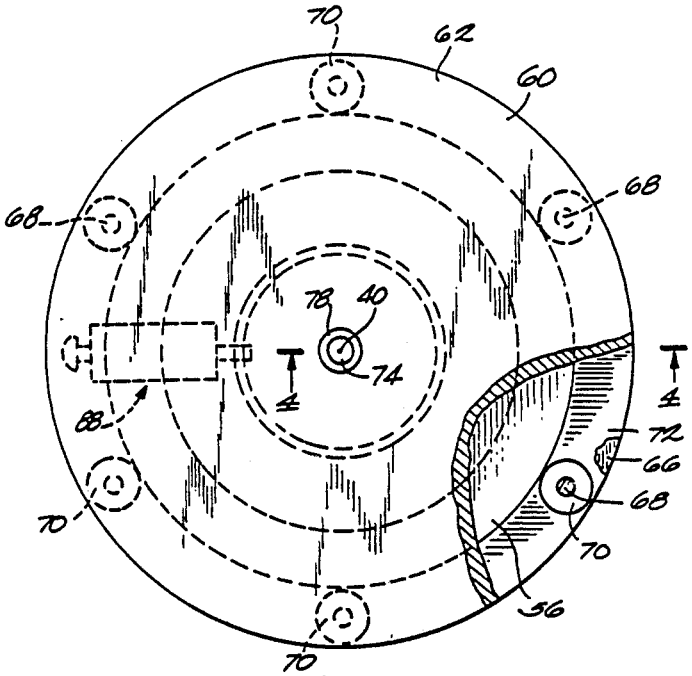
FIG. 5 is a view taken along line 5—5 in FIG. 4.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A recreational boat or marine vehicle 10 embodying the invention is illustrated in the drawings. As shown in FIG. 1, the boat 10 comprises a deck 12 including a fore or cockpit area 14 and an aft or seating area 16. As shown in FIG. 4, the deck 12 is preferably constructed of balsa wood 18 surrounded by upper and lower layers of fiberglass 20, although the deck 12 can have any suitable construction.

The boat 10 also comprises a driver's seat 22, and means mounting the driver's seat 22 on the cockpit area 14 of the deck 12 for pivotal movement about a generally vertical axis 24 and between a forwardly facing position and a rearwardly facing position. The boat 10 also comprises a forwardly facing seat 26 mounted on the seating area 16 of the deck 12 and thus located aft of the driver's seat 22.

The boat 10 further comprises an L-shaped seat 30 located adjacent the driver's seat 22. The seat 30 includes an L-shaped seat bottom member 32 including a first seat portion and a spaced second seat portion, and an L-shaped seat back member 34 including a first portion 36 extending upwardly from the first seat portion, and a second portion 38 generally perpendicular to the first portion 36 and extending upwardly from the second seat portion.

The boat 10 also comprises means mounting the seat 30 on the deck 12 for pivotal movement about a generally vertical axis 40 and between a first position (FIGS. 1 and 2) wherein the first portion 36 faces fore and the second portion 38 faces the driver's seat 22, and a second position (FIG. 3) wherein the second portion 38 faces aft and the first portion 36 faces the driver's seat 22. While various suitable mounting means can be employed, in the preferred embodiment, such means includes a floor plate 42 fixed to the deck 12, and a base plate 44 mounted on the floor plate 42. In the illustrated construction, the deck 12 is reinforced beneath the floor plate 42. More particularly, the balsa wood 18 beneath the floor plate 42 is replaced by an aluminum sheet 46 and plywood 48. The aluminum sheet 46 has thereon upwardly extending studs 50 to which the floor plate 42 is secured. Similarly, the floor plate 42 includes upwardly extending studs 52 to which the base plate 44 is secured. As shown in FIG. 4, the opposite ends of the floor plate 42 are turned upwardly. The reason for this is explained hereinafter.

The mounting means also includes a generally vertical member 54 having a lower end supported by the base plate 44, and an upper end. In the preferred embodiment, the vertical member 54 is a tube having its lower end welded to the base plate 44. The mounting means also includes a first generally horizontal plate or disc 56 mounted on the upper end of the tube 54 and having an upper surface 58. In the illustrated construction, the first plate 56 is welded to the upper end of the tube 54. The mounting means further includes a second generally horizontal plate or disc 60 supported by the upper surface 58 of the first plate 56 and having an upper surface 62. The mounting means further includes three horizontally extending brace members 64 supporting the seat 30 and mounted on the upper surface 62 of the second plate 60. In the preferred embodiment, the brace members 64 are generally U-shaped in cross section, with the "U" opening downwardly. The brace members 64 are preferably welded to the second plate 60.

The mounting means also includes means for preventing upward movement of the second plate 60 relative to the first plate 56. While various suitable preventing means can be used, in the illustrated construction, such means includes an annular member 66 located beneath the first plate 56 and fixed to the second plate 60. While the annular member 66 can be fixed to the second plate 60 by any suitable means, in the illustrated construction, the annular member 66 is fixed to the second plate 60 by a plurality of screws or bolts 68. The preventing means further includes a plurality of spacers 70 located between the annular member 66 and the second plate 60 and spaced circumferentially around the first plate 56, as shown in FIG. 5. Preferably, each spacer 70 has extending therethrough a respective bolt 68.

The mounting means further includes friction reducing means between the annular member 66 and the first plate 56. While various suitable friction reducing means can be employed, in the preferred embodiment, such means includes an annular shim 72 located between the annular member 66 and the first plate 56 and made of a low-friction material such as Teflon.

The mounting means further includes means for preventing translational movement of the second plate 60 relative to the first plate 56. While various suitable means can be employed, in the illustrated construction, such means includes a pin or projection 74 centered on the pivot axis 40 and extending upwardly from the first plate 56, and the second plate 60 has therein an aperture 76 rotatably housing the pin 74. Preferably, the aperture 76 has therein a brass bushing 78 surrounding the pin 74.

The mounting means further includes friction reducing means between the first and second plates 56 and 60. While various suitable friction reducing means can be used, in the preferred embodiment, such means includes a circular shim 80 located between the plates 56 and 60 and made of a low-friction material such as Teflon. The shim 80 has therein a central aperture 82 through which the pin 74 passes.

The mounting means further includes means for selectively and releasably locking the seat 30 in the first and second positions. The locking means preferably includes means for securing the annular member 66 relative to the first plate 56 and, more particularly, relative to the tube 54. While various suitable securing means can be employed, in the preferred embodiment, such means includes apertures 84 and 86 spaced 90° apart in the tube 54, and a conventional spring-loaded bolt assembly 88 mounted on the underside of the annular member 66. As shown in FIG. 4, the bolt assembly 88 includes a bolt 90 which is engageable with the aperture 84 for securing the seat 30 in the first position, and which is engageable with the aperture 86 for securing the seat 30 in the second position.

The boat 10 also comprises a downwardly opening box 92 surrounding the tube 54 and including a top wall 94 having therein an aperture 96 through which the tube 54 passes. The box 92 is principally cosmetic, as it covers most of the tube 54, the base plate 44, and the floor plate 42. The box 92 can also be used for mounting accessories, such as lights or speakers. As shown in FIG. 4, the lower end of the box 92 fits snugly over and is secured to the upwardly-turned ends of the floor plate 42.

An alternative embodiment of the invention is illustrated in FIG. 6. Except as described below, the alternative embodiment is substantially identical to the preferred embodiment, and common elements have been given the same reference numerals.

In the alternative embodiment, the spacers 70 are replaced by an annular spacer 100. Furthermore, the first plate 56 has a frustoconical, radially outer surface 102, and the spacer 100 has a frustoconical, radially inner surface 104 complementary with the outer surface 102 of the first plate 56. The spacer 100 maintains a spacing between the lower surface of the first plate 56 and the upper surface of the annular member 66, and the mounting means includes friction reducing means between the outer surface 102 of the first plate 56 and the inner surface 104 of the spacer 100. In the illustrated construction, this means includes an annular member 106 which is made of low friction material, such as Teflon, and which includes a frustoconical inner surface mating with the outer surface 100 of the first plate 56 and a frustoconical outer surface mating with the inner surface 104 of the spacer 100. If desired, the circular shim 80 between the first and second plates 56 and 60 can be replaced by a lubricant such as grease.

When facing forwardly, the seat 30 serves as a front passenger seat. When the seat 30 is turned to face rearwardly, the seating area 16 can be used for entertaining. The driver's seat 22 can also be turned to face rearwardly for this purpose.

Various features of the invention are set forth in the following claims.

I claim:

1. A marine vehicle comprising a deck, an L-shaped seat including a first seat back portion, a second seat back portion generally perpendicular to said first seat back portion, a first seat portion extending outwardly from said first seat back portion, and a second seat portion extending outwardly from said second seat back portion, means mounting said seat on said deck for pivotal movement about a generally vertical axis and between a first position wherein said first seat back portion faces fore and a second position wherein said second seat back portion faces aft, and means for selectively and releasably locking said seat in said first and second positions.

2. A marine vehicle as set forth in claim 1 and further comprising a driver's seat located adjacent said L-shaped seat such that said second portion faces said driver's seat when said L-shaped seat is in said first position and said first portion faces said driver's seat when said L-shaped seat is in said second position.

3. A marine vehicle as set forth in claim 2 and further comprising a forwardly facing seat mounted on said deck and located aft of said L-shaped seat and said driver's seat.

4. A marine vehicle as set forth in claim 1 wherein said mounting means includes a first generally horizontal plate supported by deck and having an upper surface, and a second generally horizontal plate supported by said upper surface of said first plate and having an upper surface supporting said L-shaped seat.

5. A marine vehicle as set forth in claim 4 wherein said mounting means further includes means for preventing upward movement of said second plate relative to said first plate.

6. A marine vehicle as set forth in claim 5 wherein said preventing means includes an annular member located beneath said first plate and fixed to said second plate.

7. A marine vehicle as set forth in claim 6 wherein said preventing means further includes a plurality of spacers located between said annular member and said second plate and spaced circumferentially around said first plate.

8. A marine vehicle as set forth in claim 6 wherein said mounting means further includes friction reducing means between said annular member and said first plate.

9. A marine vehicle as set forth in claim 6 and further comprising means for selectively and releasably locking said seat in said first and second positions, said locking means including means for securing said annular member relative to said first plate.

10. A marine vehicle as set forth in claim 6 wherein said first plate has a frustoconical, radially outer surface, and wherein said preventing means further includes an annular spacer extending between said annular member and said second plate, surrounding said first plate, and having a frustoconical, radially inner surface complementary with said outer surface of said first plate.

11. A marine vehicle as set forth in claim 10 wherein said mounting means further includes friction reducing means between said inner surface of said spacer and said outer surface of said first plate.

12. A marine vehicle as set forth in claim 11 wherein said friction reducing means includes an annular member made of low friction material and having a radially inner surface mating with said outer surface of said first member and a radially outer surface mating with said inner surface of said spacer.

13. A marine vehicle as set forth in claim 4 wherein said mounting means further includes means for preventing translational movement of said second plate relative to said first plate.

14. A marine vehicle as set forth in claim 13 wherein said preventing means includes a projection centered on said axis and extending upwardly from said first plate, and wherein said second plate has therein an aperture rotatably housing said projection.

15. A marine vehicle as set forth in claim 4 wherein said mounting means further includes a floor plate fixed to said deck, a base plate mounted on said floor plate, and a generally vertical member having a lower end supported by said base plate, and an upper end, and wherein said first plate is supported by said upper end.

16. A marine vehicle as set forth in claim 4 wherein said mounting means further includes friction reducing means between said first and second plates.

17. A marine vehicle as set forth in claim 4 wherein said mounting means further includes a horizontally extending brace member supporting said seat and mounted on said upper surface of said second plate.

18. A marine vehicle comprising a deck, a seat, and means mounting said seat on said deck for pivotal movement about a generally vertical axis, said mounting means including a first generally horizontal plate supported by said deck and having an upper surface, and a frustoconical, radially outer surface, a second generally horizontal plate supported by said upper surface of said first plate and having an upper surface supporting said seat, a pin extending along said axis and extending through said plates so that said second plate pivots about said pin, and means for preventing upward movement of said second plate relative to said first plate, said preventing means including an annular member located beneath said first plate and fixed to said second plate, and an annular spacer extending between said annular member and said second plate, surrounding said first plate, and having a frustoconical, radially inner surface complementary with said outer surface of said first plate.

19. A marine vehicle comprising a deck, a seat, and means mounting said seat on said deck for pivotal movement about a generally vertical axis, said mounting means including a first generally horizontal plate supported by said deck and having an upper surface, said first plate having a frustoconical, radially outer surface, a second generally horizontal plate supported by said upper surface of said first plate and having an upper surface supporting said seat, and means for preventing upward movement of said second plate relative to said first plate, said preventing means including an annular member located beneath said first plate and fixed to said second plate, and said preventing means further including an annular spacer extending between said annular member and said second plate, surrounding said first plate, and having a frustoconical, radially inner surface complementary with said outer surface of said first plate.

20. A marine vehicle comprising a deck, a seat comprising a generally horizontal bottom member having a first edge and a second edge extending in generally co-planar and generally perpendicular relation to said first edge, a seat back member including a first portion extending upwardly from said first edge of said bottom member, and a second portion extending upwardly from said second edge of said bottom member, and means mounting said seat on said deck for pivotal movement about a generally vertical axis and between a first position wherein said first portion faces fore and a second position wherein said second portion faces aft.

21. A marine vehicle comprising a deck, an L-shaped seat including a first seat back portion, a second seat back portion generally perpendicular to said first seat back portion, a first seat portion extending outwardly from said first seat back portion, and a second seat portion extending outwardly from said second seat back portion, and means mounting said seat on said deck for pivotal movement about a generally vertical axis and between a first position wherein said first seat back portion faces fore and a second position wherein said second seat back portion faces aft.

* * * * *